US012788129B2

(12) United States Patent
Fontaine

(10) Patent No.: US 12,788,129 B2
(45) Date of Patent: Nov. 10, 2026

(54) PORTABLE GROUND CHAIR APPARATUS

(71) Applicant: Brightside Enterprises LLC, St. Louis, MO (US)

(72) Inventor: Suzanne Fontaine, St. Louis, MO (US)

(73) Assignee: Brightside Enterprises LLC, St. Louis, MO (US)

( * ) Notice: Subject to any disclaimer, the term of this patent is extended or adjusted under 35 U.S.C. 154(b) by 86 days.

(21) Appl. No.: 18/740,174

(22) Filed: Jun. 11, 2024

(65) Prior Publication Data

US 2024/0415269 A1 Dec. 19, 2024

Related U.S. Application Data

(60) Provisional application No. 63/521,802, filed on Jun. 19, 2023.

(51) Int. Cl.
*A45F 4/02* (2006.01)

(52) U.S. Cl.
CPC ..... *A45F 4/02* (2013.01); *A45F 2004/026* (2013.01)

(58) Field of Classification Search
CPC ..... A45F 2003/003; A45F 2004/026; A45F 3/08; A45F 4/02; A47C 1/146; A47C 4/52
USPC ..... 224/575
See application file for complete search history.

(56) References Cited

U.S. PATENT DOCUMENTS 2,509,537 A * 5/1950 Stier ..... A47C 1/146 220/9.1
4,154,323 A * 5/1979 Sneider ..... A47D 15/003 383/4
5,445,301 A * 8/1995 Biedenharn, Jr. ..... A45F 3/04 224/155
6,843,398 B2 * 1/2005 Zion ..... A47C 4/52 297/118
11,006,609 B2 * 5/2021 Jakubowski ..... A01K 1/0107

FOREIGN PATENT DOCUMENTS

DE 19600573 A1 * 7/1997 ..... A45F 4/02
GB 2521839 A * 7/2015 ..... A47C 1/026

OTHER PUBLICATIONS

DE-19600573-A1 Translation, Kullmann Bernd, Jul. 10, 1997 (Year: 1997).*

* cited by examiner

*Primary Examiner* — Nathan J Newhouse
*Assistant Examiner* — Matthew T Theis
(74) *Attorney, Agent, or Firm* — Gregory Finch; Finch Paolino, LLC

(57) ABSTRACT

A portable ground chair apparatus that is collapsible and comprises an internal storage area. Certain benefits and advantages of the present disclosure include a portable ground chair with an integrated carrying capacity to enable dual seating and storage functionality. Certain embodiments of the portable ground chair may include one or more shoulder straps to enable a user to carry the portable ground chair and cargo load via one or more positions including, but not limited to, over the shoulder, crossbody, and as a backpack. Certain benefits and advantages of the present disclosure include a portable ground chair comprising a right triangular prism shape (i.e., a wedge shape) to enable a user to utilize the portable ground chair in two or more positions including, but not limited to, upright, reclined, and prone.

19 Claims, 13 Drawing Sheets

PORTABLE GROUND CHAIR APPARATUS

CROSS-REFERENCE TO RELATED APPLICATIONS

The present application claims priority benefit to U.S. Provisional Patent Application Ser. No. 63/521,802, entitled "PORTABLE GROUND CHAIR" and having a filing date of Jun. 19, 2023; the entirety of which is incorporated herein at least by virtue of this reference.

FIELD

The present disclosure relates to the field of outdoor furniture and accessories; in particular, a portable ground chair apparatus that is collapsible and comprises an internal storage area.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a portable ground chair apparatus comprising a frame assembly and a flexible shell. In accordance with certain embodiments, the frame assembly comprises a first frame member configured to define a first rectangular area, a second frame member configured to define a second rectangular area, and a third frame member configured to define a third rectangular area. In certain embodiments, the second frame member is rotatably coupled to the first frame member at a first side of the second frame member, and the second frame member is rotatably coupled to the third frame member at a second side of the second frame member, wherein the second side is opposite the first side. In accordance with certain embodiments, the frame assembly is configured to define a triangular prism shape when the frame assembly is configured in a first configuration and is configured to fold flat when the frame assembly is configured in a second configuration. In accordance with certain aspects of the present disclosure, the flexible shell is constructed of a fabric material and comprises a body portion and a face portion, wherein the face portion and the body portion are configured to define an exterior surface and an interior area of the flexible shell. In accordance with certain embodiments, the frame assembly is configured to be housed in the interior area of the flexible shell, wherein a first side of the first frame member and a first side of the third frame member are selectively coupled to a first surface of the interior area of the flexible shell when the frame assembly is configured in the first configuration.

In accordance with certain embodiments of the portable ground chair apparatus, at least a portion of the face portion of the flexible shell is removably coupled to the body portion to selectively conceal and expose the interior area of the flexible shell. In certain embodiments, the body portion of the flexible shell is configured to be disposed on the first frame member, the second frame member, and the third frame member when the frame assembly is configured in the first configuration. In certain embodiments, the second side of the second frame member and a second side of the third frame member are selectively coupled to a second surface of the interior area of the flexible shell when the frame assembly is configured in the first configuration. In certain embodiments, the first side of the first frame member and the first side of the third frame member are selectively removed from the first surface of the interior area of the flexible shell when the frame assembly is configured in the second configuration. In certain embodiments, the flexible shell is collapsible when the frame assembly is configured in the second configuration. In accordance with certain embodiments, the portable ground chair apparatus may further comprise a fabric mat coupled to a surface of the flexible shell. The flexible shell may comprise a pocket disposed on an exterior surface of the flexible shell adjacent to the face portion. The fabric mat may be configured to be selectively stored in and removed from the pocket.

Further aspects of the present disclosure provide for a portable ground chair apparatus comprising a frame assembly and a flexible shell constructed of a fabric material. The frame assembly may be configured to be selectively configured between a first configuration and a second configuration, wherein the frame assembly is configured in a triangular prism shape when configured in the first configuration, and wherein the frame assembly is configured to fold flat when configured in the second configuration. In accordance with certain embodiments, the flexible shell is configured to be disposed on all lateral edges of the frame assembly when the frame assembly is configured in the first configuration. In certain embodiments, the flexible shell is collapsible when the frame assembly is configured in the second configuration. In certain embodiments, the flexible shell comprises a zippered portion configured to selectively expose and conceal an internal area of the flexible shell. In accordance with certain embodiments, the portable ground chair apparatus may further comprise a fabric mat coupled to a surface of the flexible shell. In said embodiments, the flexible shell may comprise at least one pocket disposed on an exterior surface of the flexible shell. In said embodiments, the fabric mat is configured to be selectively stored in and removed from the at least one pocket.

Still further aspects of the present disclosure provide for a portable ground chair apparatus comprising a frame assembly configured to be selectively configured between a first configuration and a second configuration and a flexible shell constructed of a fabric material, the flexible shell comprising an exterior surface and an internal area. In accordance with certain embodiments, the frame assembly is configured in a triangular prism shape when configured in the first configuration, and the frame assembly is configured to fold flat when configured in the second configuration. In accordance with certain aspects of the present disclosure, the frame assembly is selectively housed in the internal area of the flexible shell and is selectively coupled to at least one surface of the internal area of the flexible shell when the frame assembly is configured in the first configuration. In accordance with certain embodiments, the frame assembly is selectively disconnected from the at least one surface of the internal area of the flexible shell when the frame assembly is configured in the second configuration.

In accordance with certain embodiments of the portable ground chair apparatus, the flexible shell is collapsible when the frame assembly is configured in the second configuration. The portable ground chair apparatus may further comprise a fabric mat coupled to the flexible shell. In said embodiments, the flexible shell may comprise at least one pocket disposed on the exterior surface of the flexible shell.

In said embodiments, the fabric mat may be configured to be selectively stored in, and removed from, the at least one pocket.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The apparatus of the present disclosure may be better understood from the following illustrative description with reference to the following drawings in which.

DETAILED DESCRIPTION

Figure 1:
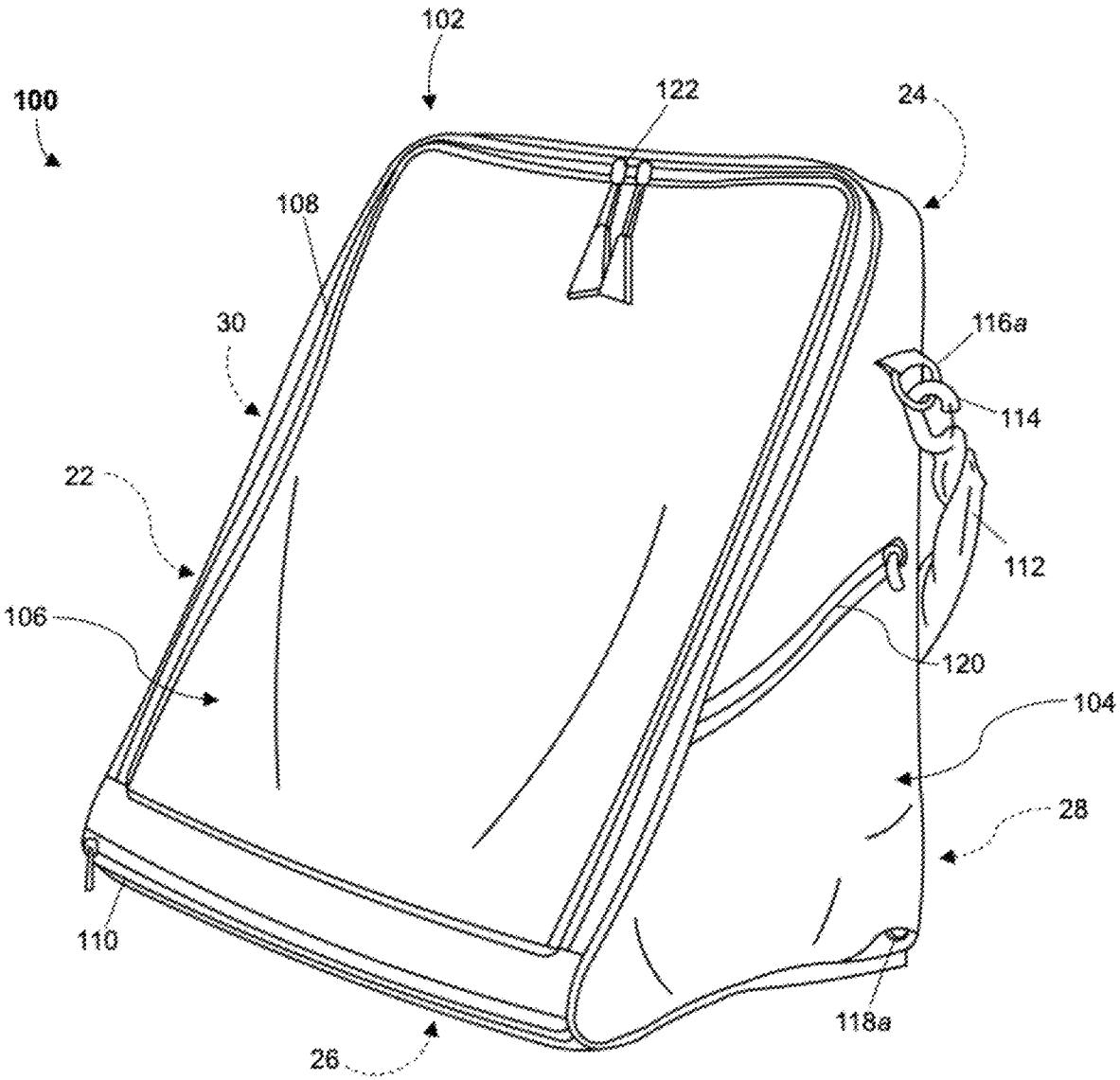
FIG. 1 is a perspective view of a portable ground chair apparatus, in accordance with certain aspects of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout. All definitions, as defined and used herein, should be understood to control over dictionary definitions, definitions in documents incorporated by reference, and/or ordinary meanings of the defined terms.

Following below are more detailed descriptions of various concepts related to, and embodiments of, inventive methods, devices and systems configured to provide for a portable ground chair apparatus that is collapsible and comprises an internal storage area.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein, the term "interface" refers to any shared boundary across which two or more separate components of a computer system may exchange information. The exchange can be between software, computer hardware, peripheral devices, humans, and combinations thereof. The term "interface" may be further defined as any shared boundary or connection between two dissimilar objects, devices or systems through which information or power is passed and/or a mechanical, functional and/or operational relationship is established and/or accomplished. Such shared boundary or connection may be physical, electrical, logical and/or combinations thereof.

As used herein, the term "assembly" refers to a combination of two or more component parts of an object.

As used herein, the term "configuration" refers to an arrangement of elements in a particular form, figure, or combination.

As used herein, the term "flexible" refers to the ability of a material to bend, move, fold, or the like; for example, as in a fabric material.

Certain benefits and advantages of the present disclosure include a portable ground chair with an integrated carrying capacity to enable dual seating and storage functionality. Certain embodiments of the portable ground chair may include one or more shoulder straps to enable a user to carry the portable ground chair and cargo load via one or more positions including, but not limited to, over the shoulder, crossbody, and as a backpack.

Certain benefits and advantages of the present disclosure include a portable ground chair comprising a right triangular prism shape (i.e., a wedge shape) to enable a user to utilize the portable ground chair in two or more positions including, but not limited to, upright, reclined, and prone.

Certain benefits and advantages of the present disclosure include a portable ground chair comprising an integrated internal frame and a fabric shell wherein the integrated internal frame is collapsible to enable the portable ground chair to be configured between an extended configuration and a collapsed configuration.

Figure 7A:
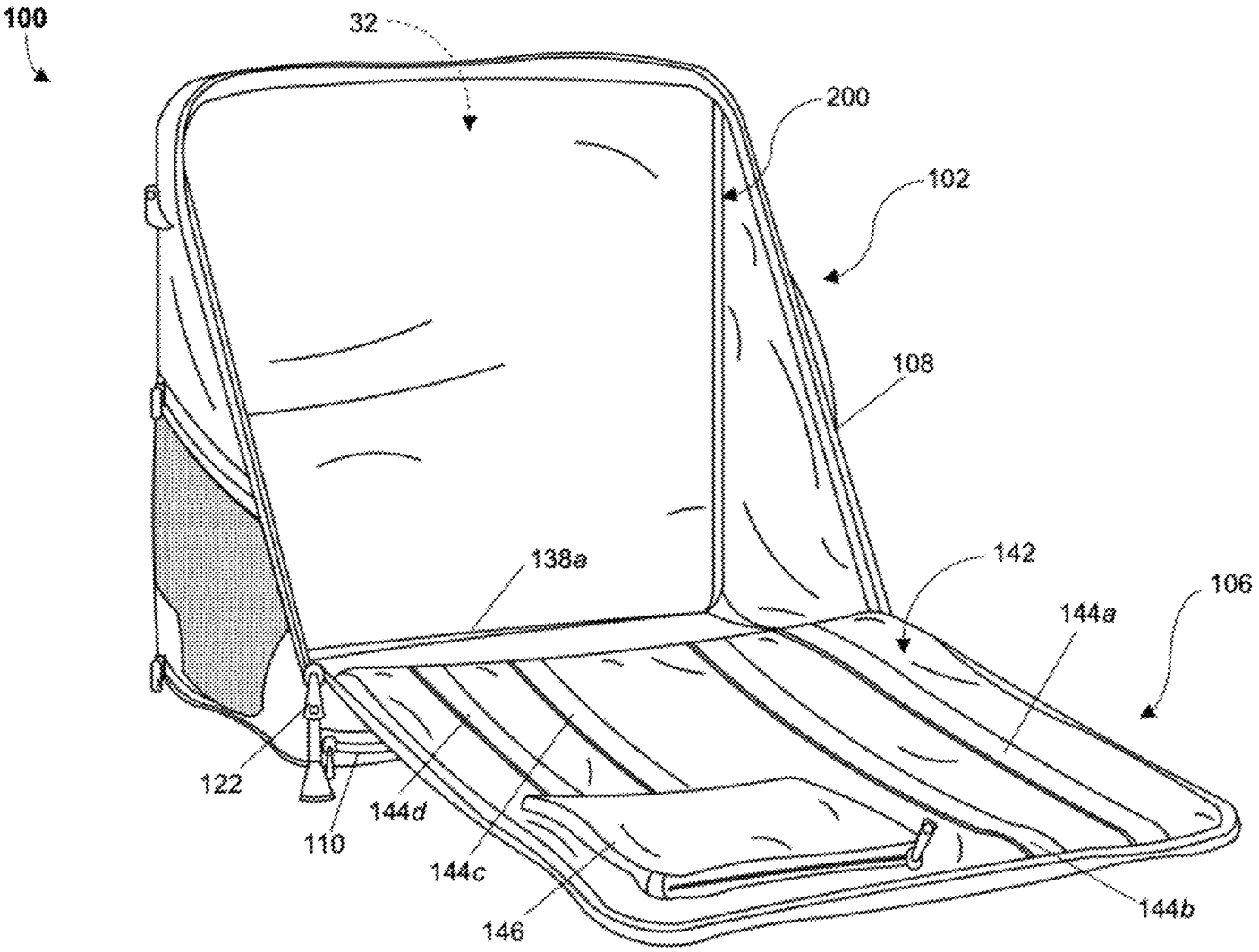
FIGS. 7A-7B are perspective views of the portable ground chair apparatus in an open configuration, in accordance with certain aspects of the present disclosure.
Figure 7B:
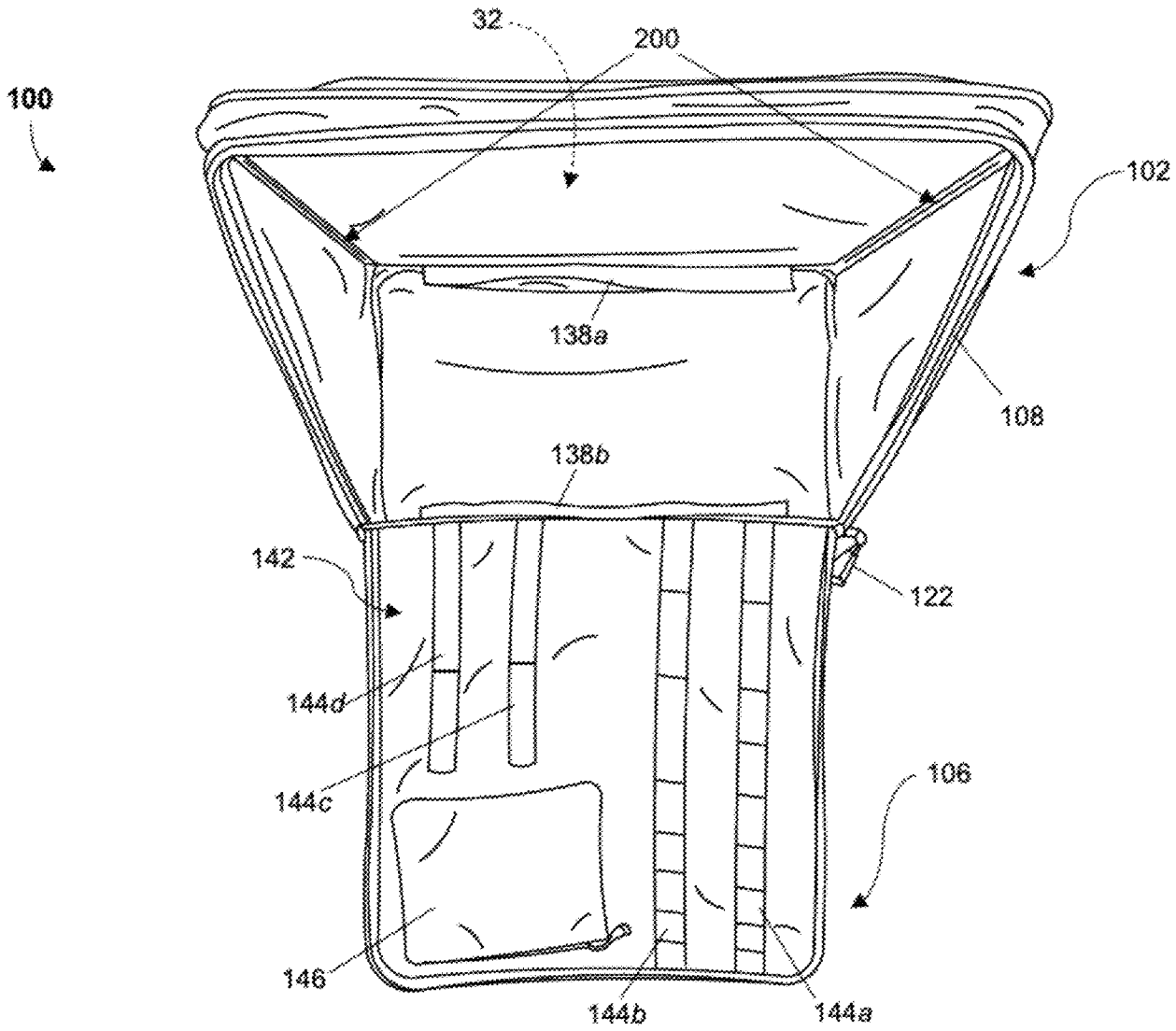

Turning now descriptively to the drawings, in which similar reference characters denote similar elements throughout the several views, FIG. 1 illustrates a perspective view of a portable ground chair apparatus 100. In accordance with certain aspects of the present disclosure, apparatus 100 comprises an internal frame (as shown and described in detail in FIGS. 9A-10) and a shell portion 102. In accordance with certain embodiments, shell portion 102 is constructed of a fabric material and is flexible (i.e., not rigid) such that apparatus 100 is collapsible when the internal frame is configured in a collapsed configuration. In accordance with certain aspects of the present disclosure, apparatus 100 comprises a wedge shape when configured in a first configuration (i.e., as shown in FIG. 1). As shown in FIG. 1, apparatus 100 comprises a right triangular prism shape (i.e., a wedge shape) comprising a first lateral face 22, a second lateral face 24 and a third lateral face 26, and a first side face 28 and a second side face 30. In accordance with certain embodiments, apparatus 100 comprises a front panel 106 and a zippered closure 108 (e.g., comprising at least one zipper pull 122) configured to selectively open and close front panel 106 to reveal an internal area of apparatus 100 (as shown in FIGS. 7A-7B). In accordance with certain aspects of the present disclosure, front panel 106 may substantially define the first lateral face 22 of apparatus 100, and second lateral face 24, third lateral face 26, first side face 28 and second side face 30 may collectively define a body portion of apparatus 100. As shown in FIG. 1, apparatus 100 may comprise one or more pockets or storage areas including a front pocket 110 and a side pocket 120. Apparatus 100 may further comprise a carrying strap 112 comprising an attachment portion 114 configured to attach to a first D-ring 116*a* to selectively secure carrying strap 112 to shell portion 102. Apparatus 100 may further comprise one or more additional D-rings for connecting to selectively secure carrying strap 112 to shell portion 102 including, but not limited to, a first lower D-ring 118*a*.

Figure 2:
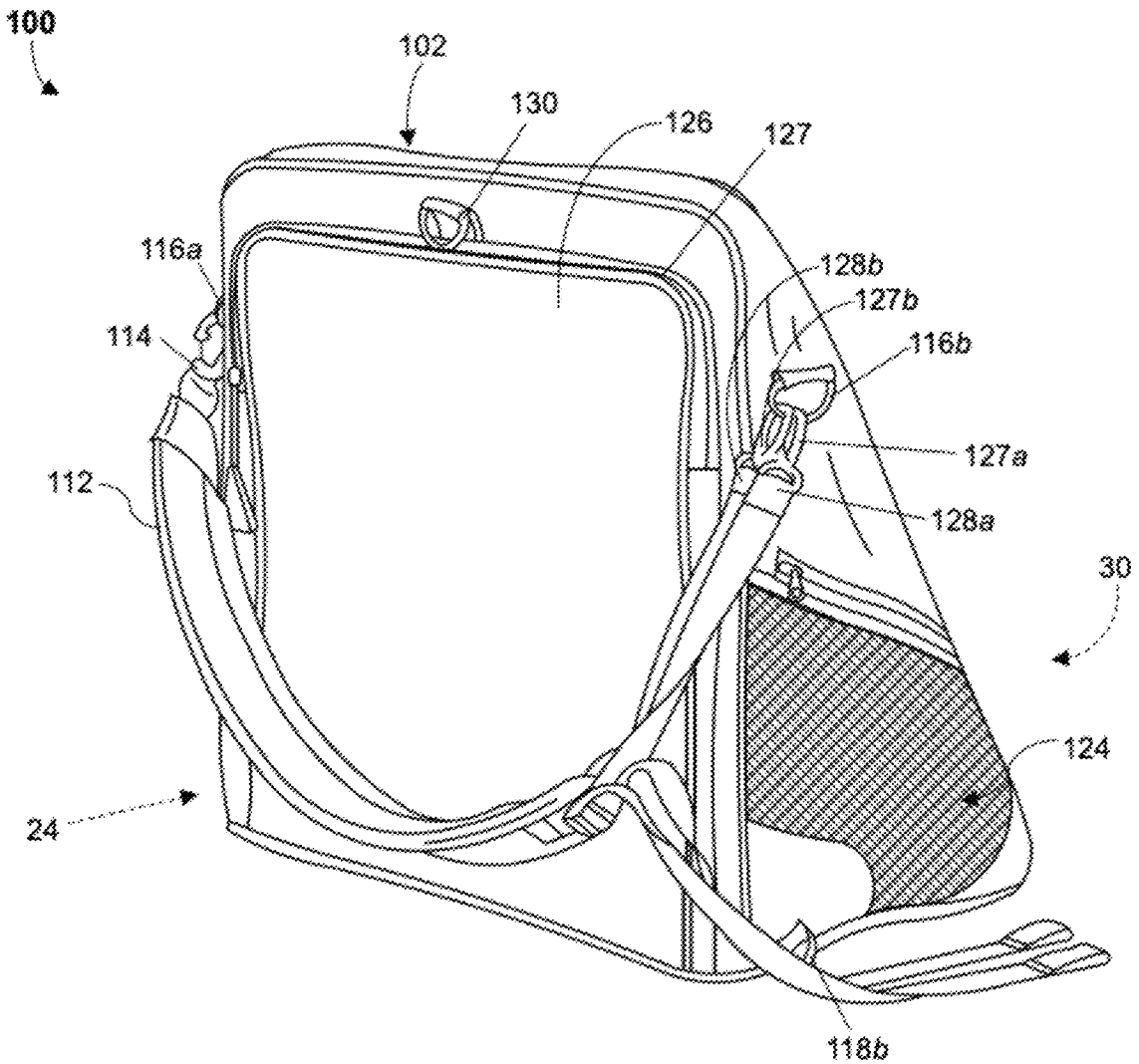
FIG. 2 is a perspective view of the portable ground chair apparatus, in accordance with certain aspects of the present disclosure.

FIG. 2 illustrates an alternative perspective view of portable ground chair apparatus 100 (e.g., in which second lateral face 24 is prominent). In accordance with certain embodiments, apparatus 100 further comprises a rear pocket 126 disposed on the second lateral face 24 of shell portion 102. Rear pocket 126 may further comprise a second zippered closure 127 configured to open/close rear pocket 126. In certain embodiments, apparatus 100 further comprises a pouch 124 disposed on the second side face 30 of shell portion 102. As shown in FIG. 2, apparatus 100 may comprise first D-ring 116*a*, a second D-ring 116*b*, a second lower D-ring 118*b* and a central D-ring 130. Strap 112 may further comprise a first strap segment 128*a* and a second strap segment 128*b*. First strap segment 128*a* may comprise a first hook attachment 127*a* and second strap segment 128*b* may comprise a second hook attachment 127*b*. As shown in FIG. 2, strap 112 is configured in a shoulder strap configuration wherein attachment portion 114 is selectively coupled to first D-ring 116*a* and first hook attachment 127*a* and second hook attachment 127*b* are selectively coupled to second D-ring 116*b*.

Figure 3:
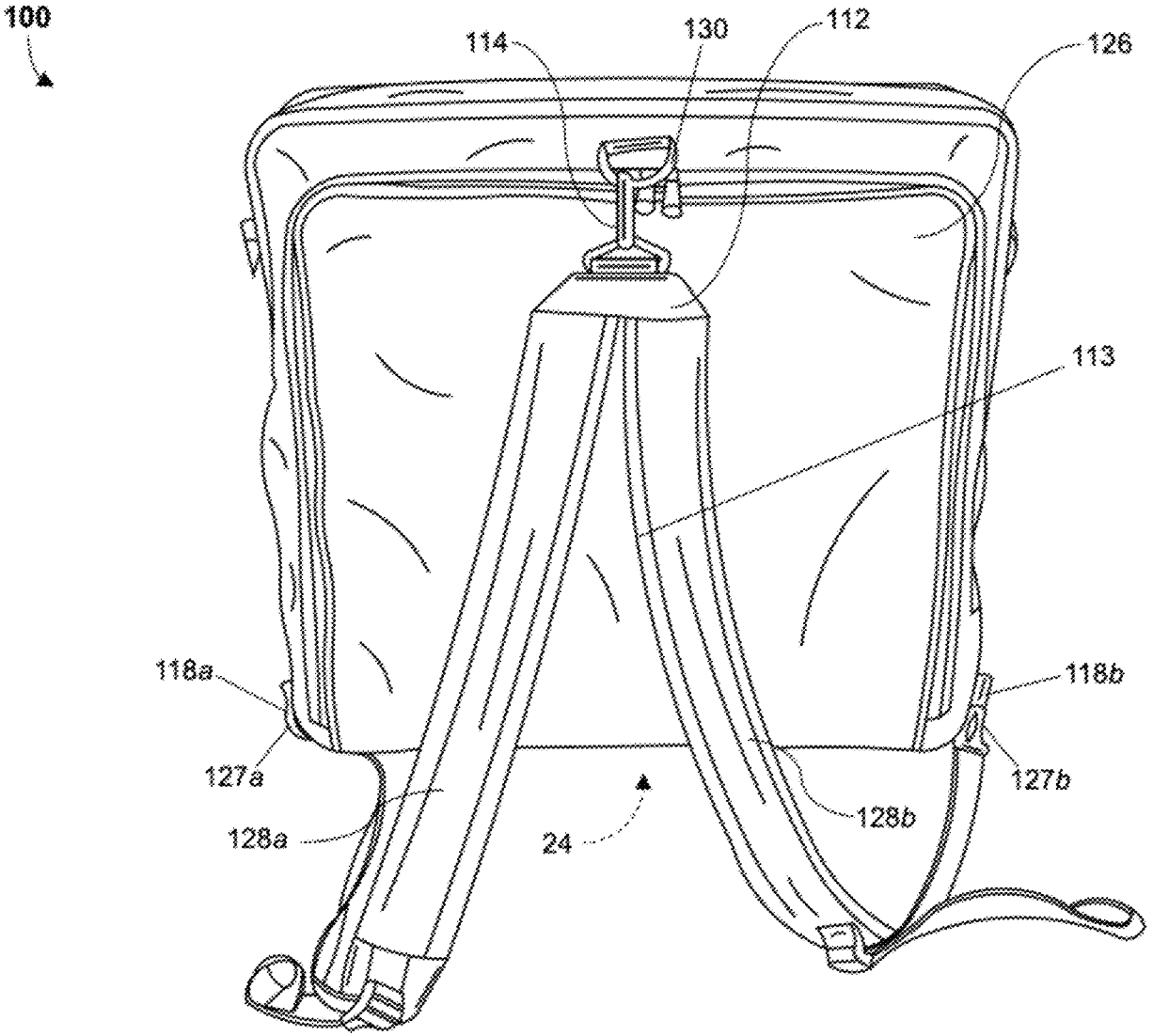
FIG. 3 is a rear view of the portable ground chair apparatus, in accordance with certain aspects of the present disclosure.

FIG. 3 illustrates a rear view of portable ground chair apparatus 100 (e.g., in which second lateral face 24 is prominent). As shown in FIG. 3, apparatus 100 is configured in a backpack configuration. In accordance with certain embodiments, strap 112 may comprise a zipper 113 configured to couple a lateral edge of first strap segment 128*a* to a lateral edge of second strap segment 128*b*. As shown in FIG. 3, when zipper 113 is configured in an open position, first strap segment 128*a* and second strap segment 128*b* are configured as backpack straps. In accordance with certain embodiments, when apparatus 100 is configured in the backpack configuration, first hook attachment 127*a* may be coupled to first lower D-ring 118*a* to enable a first attachment point for strap 112 and second hook attachment 127*b* may be coupled to second lower D-ring 118*b* to enable a second attachment point for strap 112. In said embodiments, attachment portion 114 may be coupled to central D-ring 130 to enable a central attachment point for strap 112. In accordance with certain aspects of the present disclosure, first lower D-ring 118*a*, second lower D-ring 118*b* and central D-ring 130 may be oriented on apparatus 100 so as to not obscure access to rear pocket 126 when apparatus 100 is configured in the backpack configuration. In accordance with an exemplary use case, apparatus 100 may be carried on a user's back when apparatus 100 is configured in the backpack configuration (i.e., as shown in FIG. 3).

Figure 4:
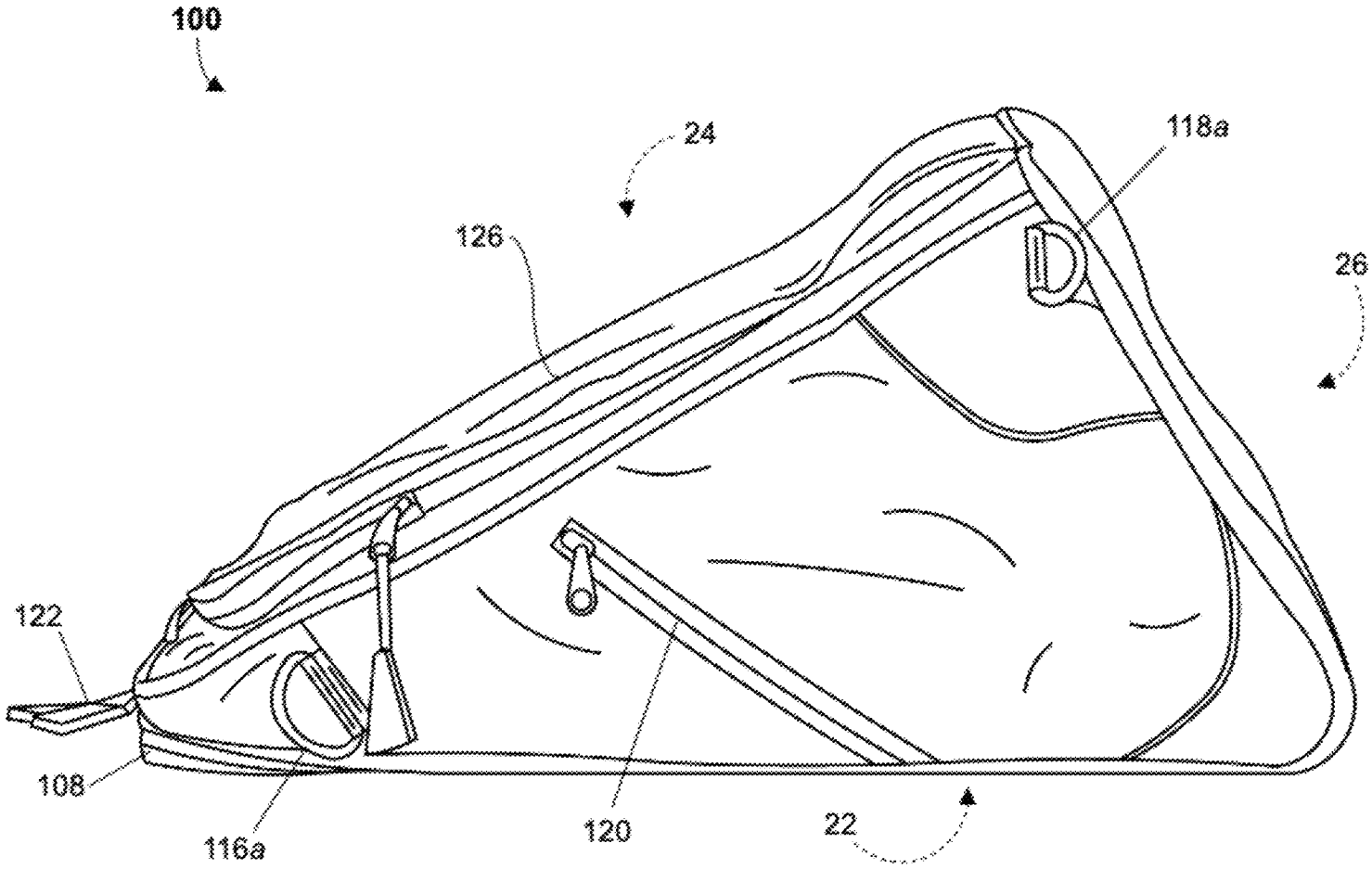
FIG. 4 is a side view of the portable ground chair apparatus, in accordance with certain aspects of the present disclosure.
Figure 11A:
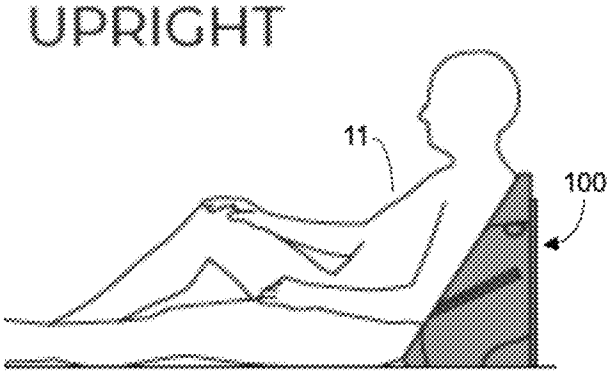
FIGS. 11A-11C are functional illustrations of exemplary use cases for the portable ground chair apparatus.
Figure 11B:
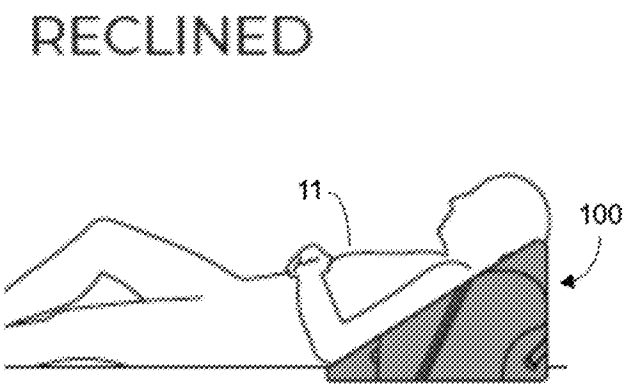
Figure 11C:
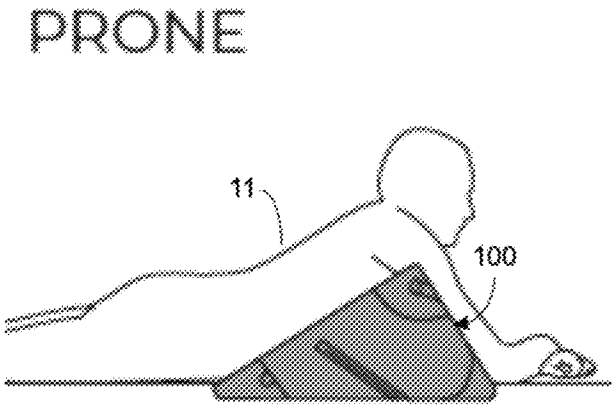

Referring now to FIG. 4, a side view of the portable ground chair apparatus 100 is shown. As shown in FIG. 4, apparatus 100 is oriented in a first reclined configuration wherein first lateral face 22 is oriented as a bottom surface of apparatus 100, second lateral face 24 is oriented as a front surface of apparatus 100 and a third lateral face 26 is oriented as a rear surface of apparatus 100. As shown in FIG. 4, rear pocket 126, side pocket 120, first lower D-ring 118*a*, zippered closure 108 and zipper pull 122, and first D-ring 116*a* are shown as oriented in the first reclined configuration. In accordance with an exemplary use case, a use may place apparatus 100 on a ground surface (e.g., wherein first lateral face 22 is in contact with the ground surface) to orient apparatus 100 in a reclined configuration. The user may rest the user's back or torso against apparatus 100 (e.g., in contact with rear pocket 126) to utilize apparatus 100 as a ground chair (e.g., as shown in FIGS. 11B and 11C).

Figure 5:
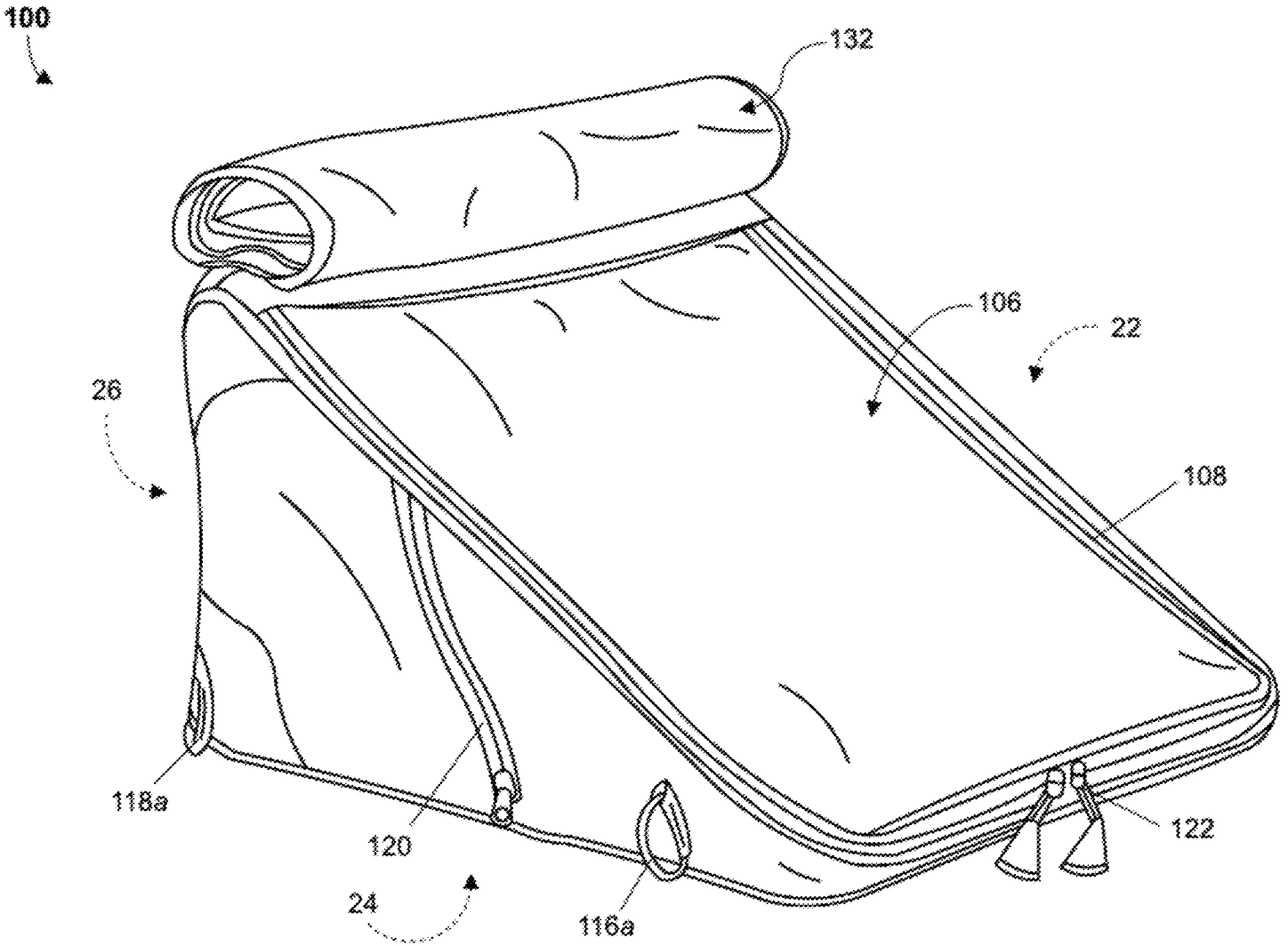
FIG. 5 is a perspective view of the portable ground chair apparatus, in accordance with certain aspects of the present disclosure.

Referring now to FIG. 5, a perspective view of the portable ground chair apparatus is shown. As shown in FIG. 5, apparatus 100 is oriented in a second reclined configuration wherein first lateral face 22 is oriented as a front surface of apparatus 100, second lateral face 24 is oriented as a bottom surface of apparatus 100 and a third lateral face 26 is oriented as a rear surface of apparatus 100. As shown in FIG. 5, front panel 106, side pocket 120, first lower D-ring 118*a*, zippered closure 108 and zipper pull 122, and first D-ring 116*a* are shown as oriented in the second reclined configuration. In accordance with certain aspects of the present disclosure, apparatus 100 may further comprise a ground mat 132. As shown in FIG. 5, ground mat 132 is shown in a rolled-up configuration. In accordance with certain embodiments, ground mat 132 is stored in front pocket 110 when not in use (shown in FIG. 1) and may be selectively removed for use by a user.

Figure 6:
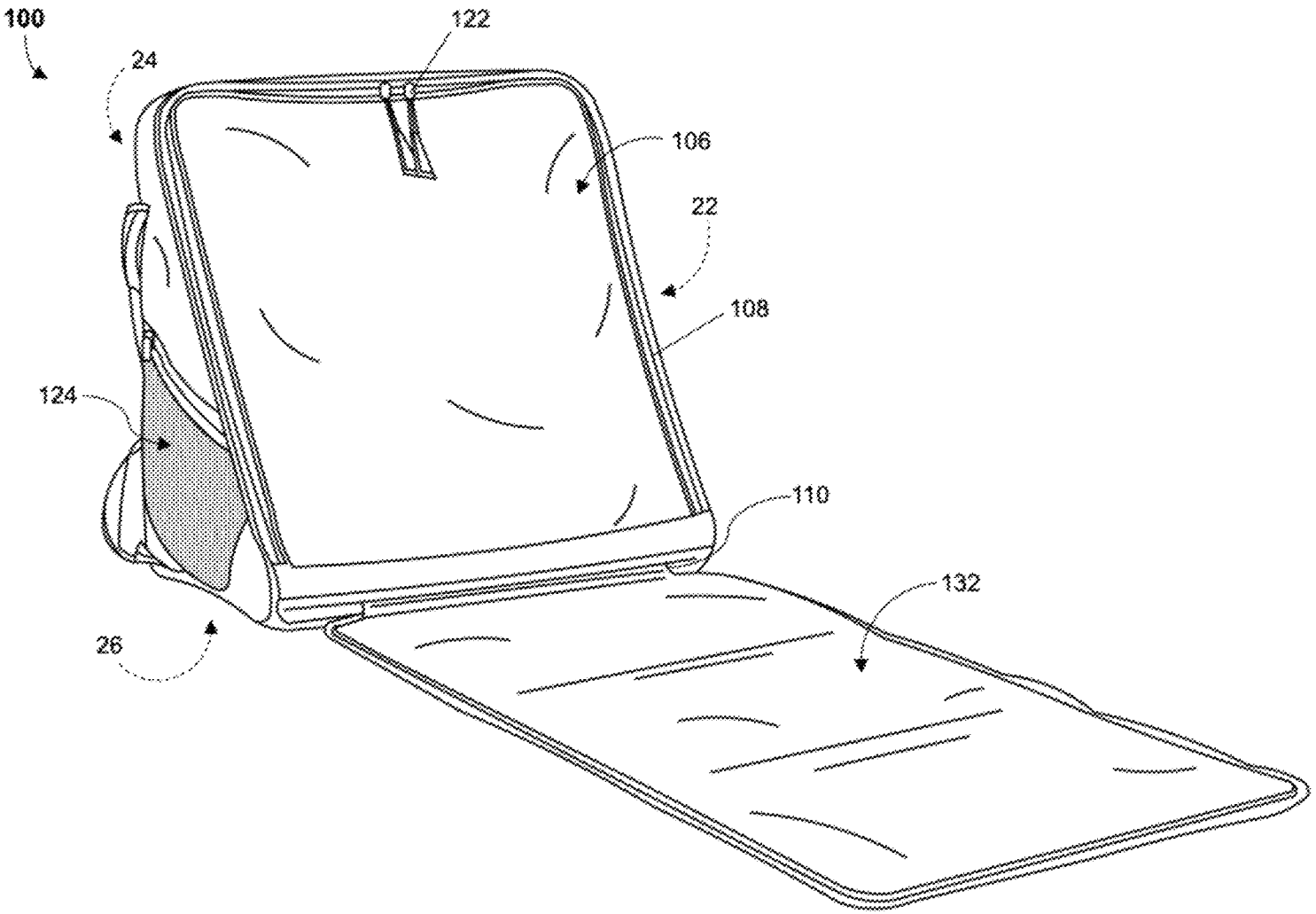
FIG. 6 is a perspective view of the portable ground chair apparatus, in accordance with certain aspects of the present disclosure.

Referring now to FIG. 6, a perspective view of portable ground chair apparatus 100 is shown. As shown in FIG. 6, apparatus 100 is oriented in an upright configuration wherein first lateral face 22 is oriented as a front surface of apparatus 100, second lateral face 24 is oriented as a rear surface of apparatus 100 and a third lateral face 26 is oriented as a bottom surface of apparatus 100. As shown in FIG. 6, front panel 106, pouch 124, zippered closure 108 and zipper pull 122, and front pocket 110 are shown as oriented in the upright configuration. As shown in FIG. 6, ground mat 132 is shown in an extended configuration. In accordance with certain aspects of the present disclosure, ground mat 132 is deployed from front pocket 110 for use by a user when apparatus 100 is oriented in the upright configuration. In accordance with certain embodiments, a first side of ground mat 132 is coupled to a surface of front pocket 110 (i.e., such that ground mat 132 is securely coupled to apparatus 100). In certain embodiments, the first side of ground mat 132 may be securely coupled to the surface of front pocket 110 via a zipper or other attachment means to enable ground mat 132 to be removed for cleaning. In accordance with certain exemplary use cases, a user may sit on ground mat 132 and rest his or her back against front panel 106 to utilize apparatus 100 as a ground chair in the upright configuration. In accordance with certain aspects of the present disclosure, the secure interface between ground mat 132 and the surface of front pocket 110 and the user's body weight applied against the surface of ground mat 132 prevents apparatus 100 from sliding backward when the user rests his or her back against front panel 106 when utilizing apparatus 100 as a ground chair in the upright configuration (i.e., as shown in FIG. 11A).

Referring now to FIGS. 7A-7B, perspective views of portable ground chair apparatus 100 in an open configuration are shown. As shown in FIGS. 7A-7B, apparatus 100 comprises an interior area 32. In accordance with certain aspects of the present disclosure, a user may engage zipper pull 122 to open zippered closure 108 in order to expose interior area 32. In accordance with certain embodiments, front panel 106 may comprise an interior surface 142. Interior surface 142 may comprise one or more of a first strap 144*a*, a second strap 144*b*, a third strap 144*c* and a fourth strap 144*d* disposed thereon. One or more of first strap 144*a*, second strap 144*b*, third strap 144*c* and fourth strap 144*d* may comprise elastic straps configured to retain one or more items (e.g., utensils, etc.) in contact with interior surface 142. In certain embodiment, apparatus 100 may comprise one or more interior pocket 146 disposed on interior surface 142 (or other surface of interior area 32).

In accordance with certain aspects of the present disclosure, apparatus 100 comprises an internal frame 200. In accordance with certain embodiments, internal frame 200 is housed in interior area 32 and is configured to provide structural support and stability to shell portion 102. In accordance with certain embodiments (e.g., as shown in FIG. 7B), apparatus 100 may comprise a first frame attachment portion 138*a* and a second frame attachment portion 138*b* disposed on a surface of interior area 32. In certain embodiments, first frame attachment portion 138*a* and second frame attachment portion 138*b* may comprise a hook and loop closure (e.g., VELCRO) configured to wrap around and secure a bottom portion of internal frame 200.

Figure 8:
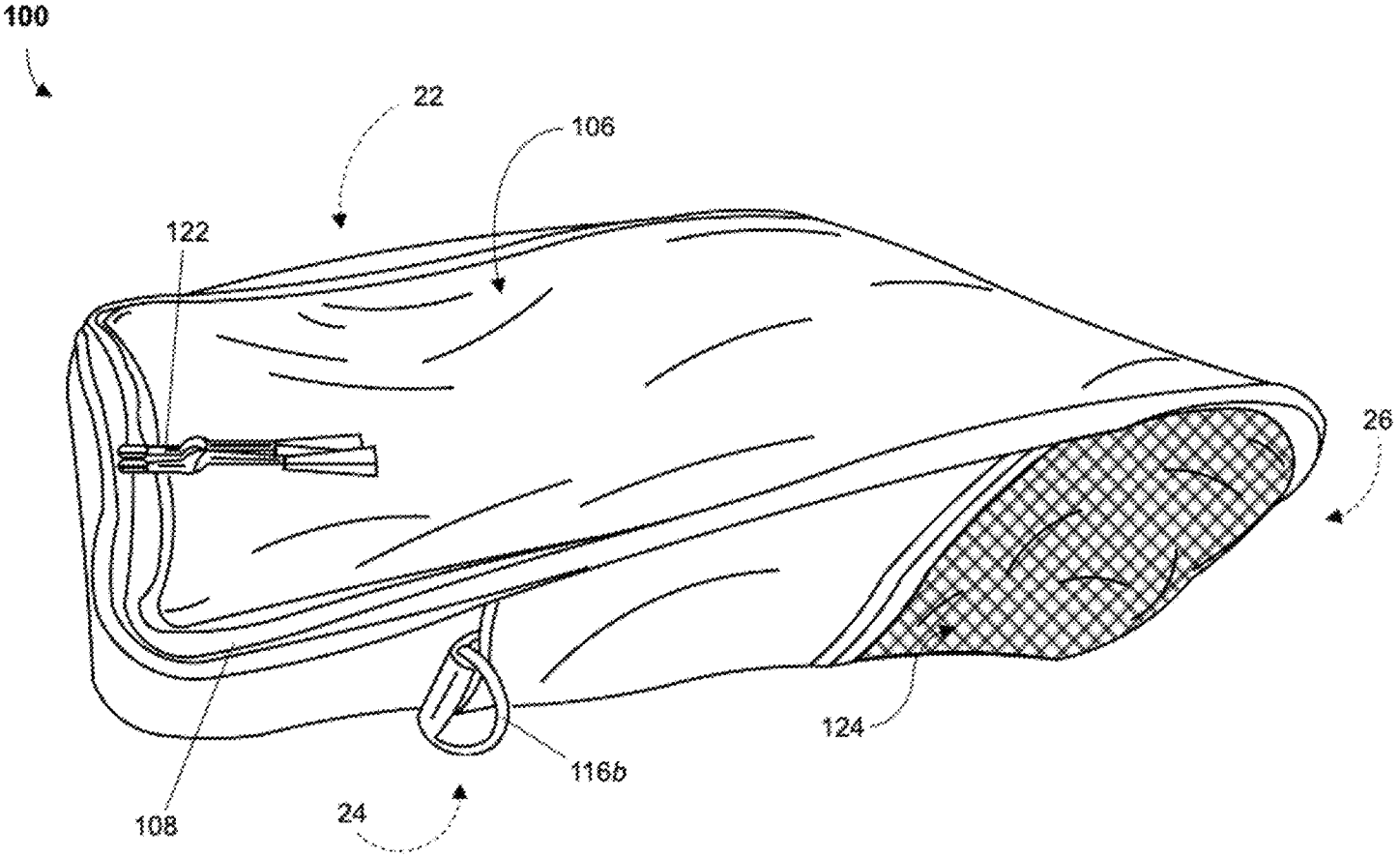
FIG. 8 is a perspective view of the portable ground chair apparatus in a collapsed configuration, in accordance with certain aspects of the present disclosure.

Referring now to FIG. 8, a perspective view of portable ground chair apparatus 100 is shown. As shown in FIG. 8, apparatus 100 is configured in a collapsed configuration wherein first lateral face 22 is oriented as a front surface of apparatus 100, second lateral face 24 is oriented as a bottom surface of apparatus 100 and a third lateral face 26 is oriented as a lateral surface of apparatus 100. As shown in FIG. 8, front panel 106, pouch 124, zippered closure 108 and zipper pull 122, and second D-ring 116*b* are shown as oriented in the collapsed configuration. In accordance with certain aspects of the present disclosure, apparatus 100 may be configured in the collapsed configured (i.e., as shown in FIG. 8) in response to a user removing the bottom portion of internal frame 200 from the first frame attachment portion 138*a* and/or second frame attachment portion 138*b* and configuring internal frame 200 in a flat configuration (i.e., as shown in FIG. 10). In response to removing the bottom portion of internal frame 200 from the first frame attachment portion 138*a* and/or second frame attachment portion 138*b* and configuring internal frame 200 in a flat configuration, internal frame 200 ceases to provide structural support and stability to third lateral face 26 of apparatus 100, which enables third lateral face 26 to collapse and thereby enables the user to configure apparatus 100 in the collapsed configuration. In accordance with certain exemplary use cases, the user may configure apparatus 100 in the collapsed configuration for storage or transport (e.g., to reduce the volume of apparatus 100). In accordance with certain exemplary use cases, the user may configure apparatus 100 in an extended configuration (e.g., as shown in FIGS. 1-7B) for use by configuring internal frame 200 in an upright configuration (e.g., as shown in FIGS. 9A-9B) and coupling the bottom portion of internal frame 200 to the first frame attachment portion 138 and second frame attachment portion 138*b* (e.g., as shown in FIG. 7B).

Figure 9A:
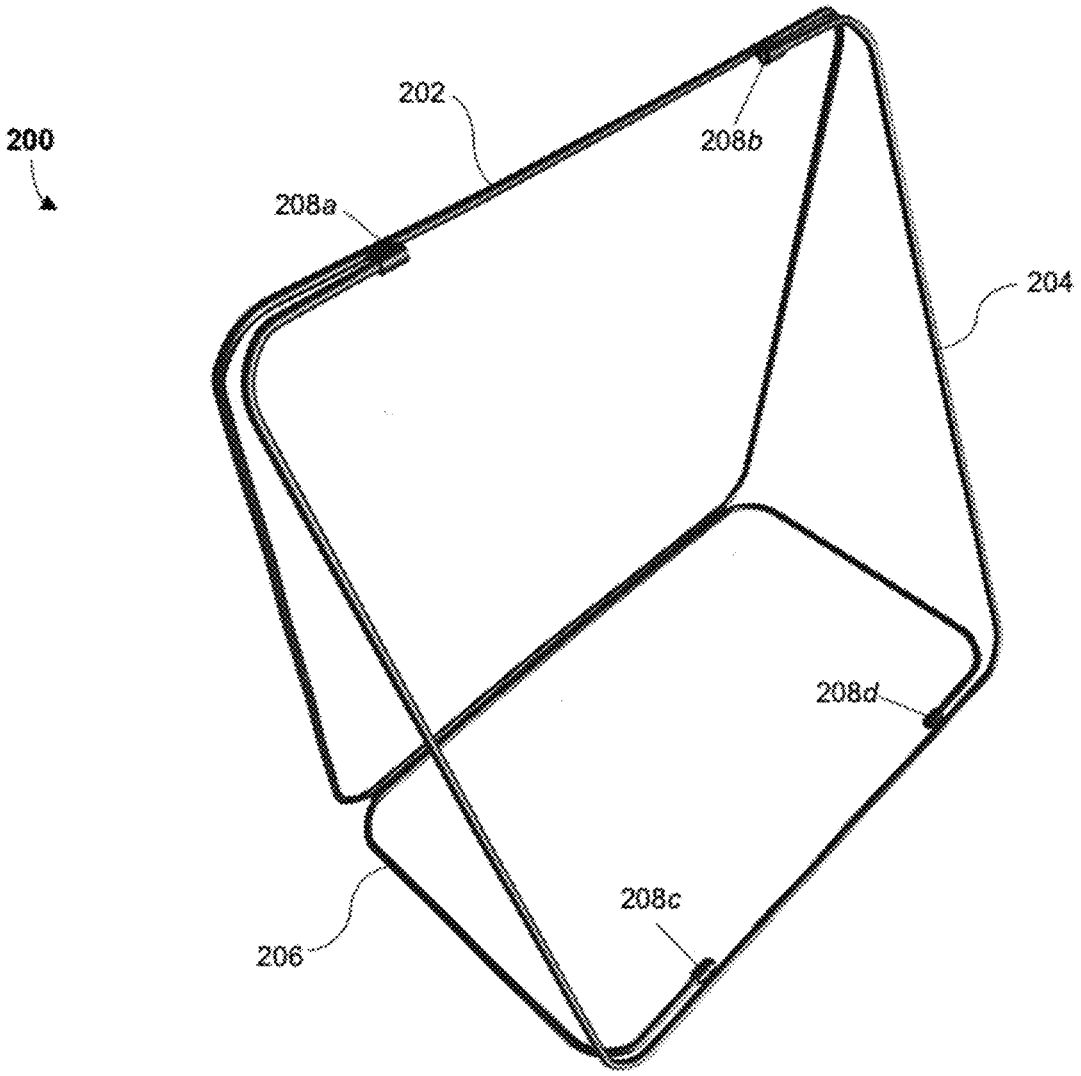
FIGS. 9A-9B are perspective views of a frame assembly of the portable ground chair apparatus in a first configuration, in accordance with certain aspects of the present disclosure.
Figure 9B:
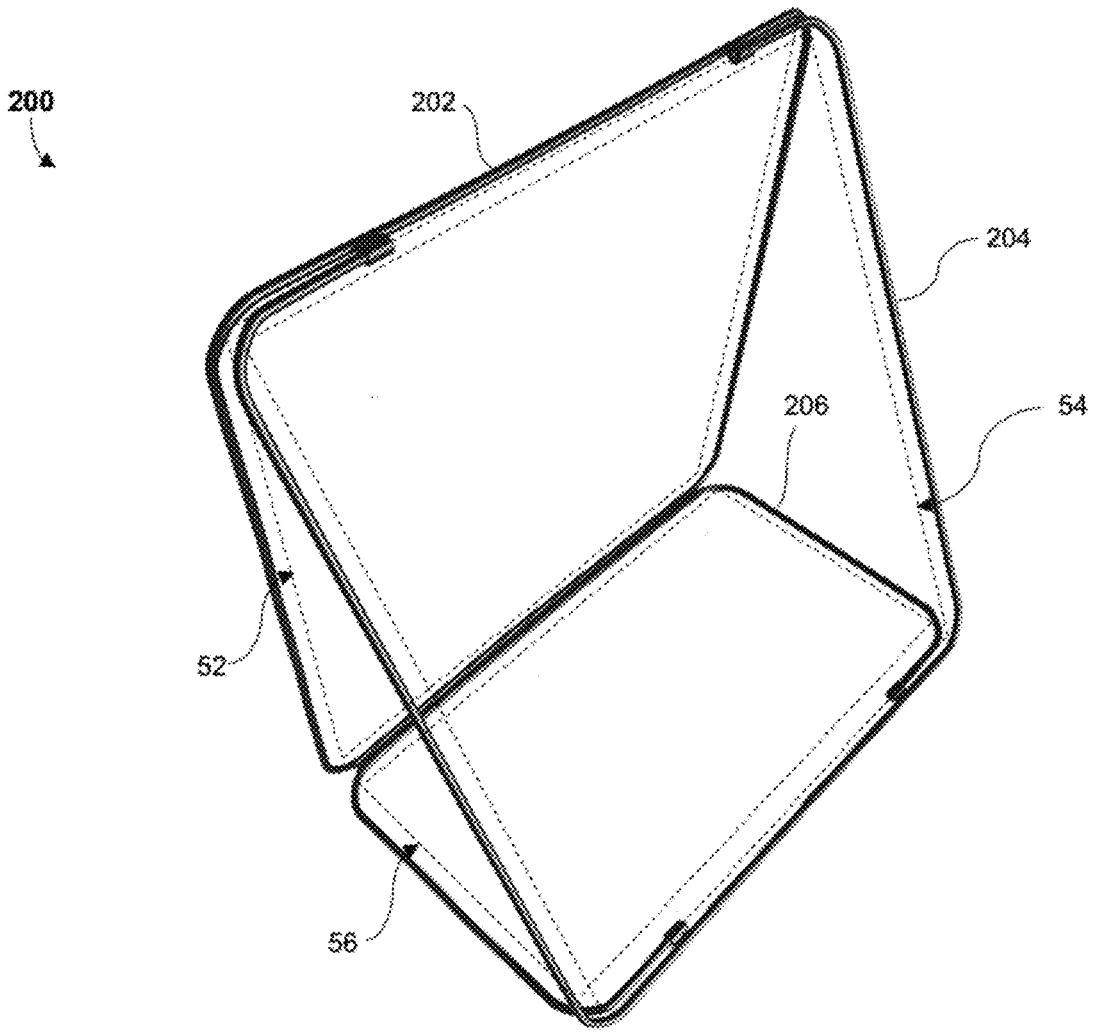
Figure 10:
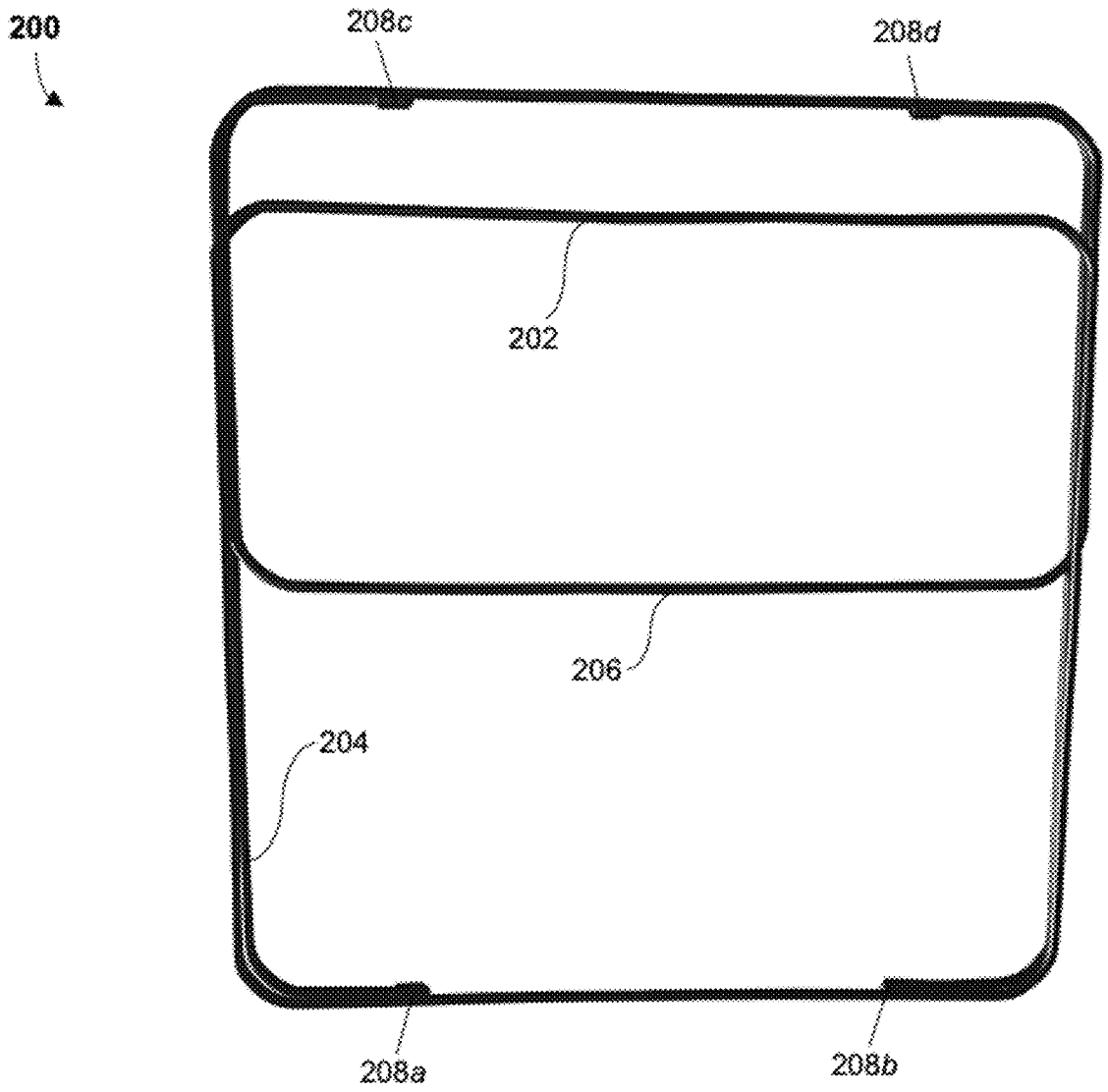
FIG. 10 is a perspective view of a frame assembly of the portable ground chair apparatus in a second configuration, in accordance with certain aspects of the present disclosure.

Referring now to FIGS. 9A-10, perspective views of internal frame 200 of portable ground chair apparatus 100 (as shown in FIGS. 1-8) are shown. In accordance with certain aspects of the present disclosure, internal frame 200 comprises a frame assembly comprising a first frame member 202, a second frame member 204, a third frame member 206, a first frame coupling 208*a*, a second frame coupling 208*b*, a third frame coupling 208*c*, and a fourth frame coupling 208*d*. In certain embodiments, first frame member 202, second frame member 204 and third frame member 206 may be constructed of steel, high-strength aluminum, or other metal or metal alloy, high-strength plastic, carbon-fiber, or other suitable material configured to provide a high strength-to-weight ratio and sufficient strength to support the weight of an adult male when apparatus 100 is utilized as a ground chair (e.g., as shown in FIGS. 11A-11C). In certain embodiments, first frame member 202, second frame member 204 and third frame member 206 are constructed of extruded metal tubes or rods. In accordance with certain embodiments, internal frame 200 may be assembled wherein a first side of first frame member 202 is coupled to a first side of second frame member 204 via first frame coupling 208*a* and second frame coupling 208*b*. Internal frame 200 may be further assembled wherein a second side of second frame member 204 (i.e., opposite the first side of second frame member 204) is coupled to a first side of third frame member 206 via third frame coupling 208*c* and fourth frame coupling 208*d*. In accordance with certain exemplary embodiments, first frame coupling 208*a* and second frame coupling 208*b* are configured such that second frame member 204 may freely rotate around an axis of first frame coupling 208*a* and second frame coupling 208*b*. In said embodiments, third frame coupling 208*c* and fourth frame coupling 208*d* are configured such that third frame member 206 may freely rotate around an axis of third frame coupling 208*c* and second frame coupling 208*d*. In certain embodiments, first frame coupling 208*a* and second frame coupling 208*b* are configured wherein one or both of first frame member 202 and second frame member 204 may freely rotate around an axis of first frame coupling 208*a* and second frame coupling 208*b*. In certain embodiments, third frame coupling 208*c* and fourth frame coupling 208*d* are configured wherein one or both of second frame member 204 and third frame member 206 may freely rotate around an axis of third frame coupling 208*c* and fourth frame coupling 208*d*. In accordance with certain embodiments, first frame member 202 is not connected to third lateral frame member 206.

In accordance with certain aspects of the present disclosure, the rotatable interface between first frame member 202, second frame member 204 and third frame member 206 and first frame coupling 208*a*, second frame coupling 208*b*, third frame coupling 208*c* and fourth frame coupling 208*d* enables a user to configure internal frame 200 between at least a first configuration (e.g., as shown in FIGS. 9A-9B) and a second configuration (e.g., as shown in FIG. 10). As shown in FIG. 9B, internal frame 200 may be configured in a first (i.e., extended) configuration. The first (i.e., extended) configuration may substantially define a right triangular prism shape defining a first lateral face area 52, a second lateral face area 54 and a third lateral face area 56. In accordance with certain aspects of the present disclosure, internal frame 200 is configured in the first (i.e., extended) configuration when apparatus 100 is operably engaged for use as a ground chair (i.e., as shown in FIGS. 1-8). As shown in FIGS. 7A-7B, a second side of first frame member 202 and a second side of third frame member 206 are retained in interior area 32 of apparatus 100 via first frame attachment portion 138*a* and a second side of second from member 204 is retained in interior area 32 of apparatus 100 via second frame attachment portion 138*b*.

In certain alternative embodiments, first frame coupling 208*a*, second frame coupling 208*b*, third frame coupling 208*c* and fourth frame coupling 208*d* may each comprise a metal connector or pin that passes through an aperture of first frame member 202, second frame member 204 and/or third frame member 206. The metal connector or pin may be held in place by a rivet or a plastic or metal stopper. In said embodiments, first frame coupling 208*a*, second frame coupling 208*b*, third frame coupling 208*c* and fourth frame coupling 208*d* may further comprise a clamp-like connector or clip that is configured to establish a friction-fit interface with a surface of first frame member 202, second frame member 204 and/or third frame member 206 in order to selectively retain first frame member 202, second frame member 204 and third frame member 206 in the first configuration (e.g., as shown in FIGS. 9A-9B). The clamp-like connector or clip is further configured to enable a user to selectively release the friction-fit interface to configure first frame member 202, second frame member 204 and third frame member 206 in the second configuration (e.g., as shown in FIG. 10). In certain embodiments, internal frame 200 may further comprise a foam padding disposed on a surface of one or more of first frame member 202, second frame member 204 and third frame member 206. In said embodiments, internal frame 200 may further comprise one or more clip or retaining means configured to retain the foam padding at a desired position on the surface of first frame member 202, second frame member 204 and/or third frame member 206.

As shown in FIG. 10, internal frame 200 may be configured in a second (i.e., collapsed) configuration wherein third frame member 206 is rotated from the first (i.e., extended) configuration such that third frame member 206 is oriented parallel to second frame member 204, and second frame member 204 is rotated from the first (i.e., extended) configuration such that second frame member 204 is oriented parallel to first frame member 202. As shown in FIG. 10, when internal frame 200 is configured in the second (i.e., collapsed) configuration, each of first frame member 202, second frame member 204 and third frame member 206 are stacked on top of each other such that internal frame 200 may be laid flat. In accordance with certain aspects of the present disclosure, internal frame 200 is configured in the second (i.e., collapsed) configuration when apparatus 100 is configured in the collapsed configuration (as shown in FIG. 8). In accordance with certain exemplary use cases, a user may configure internal frame 200 in the second (i.e., collapsed) configuration by removing first frame member 202 and/or third frame member 206 from first frame attachment portion 138*a* (as shown in FIG. 7B) and/or removing second frame member 204 from second frame attachment portion 138*b* (as shown in FIG. 7B) and rotating second frame member 204 and third frame member 206 into the second (i.e., collapsed) configuration. In accordance with certain aspects of the present disclosure, apparatus 100 may subsequently be configured into the collapsed configuration (as shown in FIG. 8).

Referring now to FIGS. 11A-11C, functional illustrations of exemplary use cases for portable ground chair apparatus 100 are shown. In accordance with certain aspects of the present disclosure, apparatus 100 may be used by a user as a ground chair in an upright configuration, a reclined configuration and/or a prone configuration. In accordance with certain exemplary use cases, FIG. 11A illustrates a use case in which a user 11 may utilize apparatus 100 as a ground chair in an upright position. In accordance with certain exemplary use cases, FIG. 11B illustrates a use case in which user 11 may utilize apparatus 100 as a ground chair in a reclined position. In accordance with certain exemplary use cases, FIG. 11C illustrates a use case in which user 11 may utilize apparatus 100 as a ground chair in a prone position.

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof. As used herein, "exemplary" means serving as an example or illustration and does not necessarily denote ideal or best.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. An apparatus comprising:

a frame assembly comprising a first frame member configured to define a first rectangular area, a second frame member configured to define a second rectangular area, and a third frame member configured to define a third rectangular area, wherein the second frame member is rotatably coupled to the first frame member at a first side of the second frame member, and wherein the second frame member is rotatably coupled to the third frame member at a second side of the second frame member, wherein the second side is opposite the first side, wherein the first frame member is not directly connected to the third frame member, wherein the frame assembly is configured to define a triangular prism shape when the frame assembly is configured in a first configuration and is configured to fold flat when the frame assembly is configured in a second configuration; and a flexible shell constructed of a fabric material, the flexible shell comprising an exterior surface and an interior area, wherein the frame assembly is configured to be housed in the interior area of the flexible shell, wherein the flexible shell comprises a front panel and a zippered closure configured to selectively open and close the front panel to expose the interior area, wherein an interior surface of the flexible shell comprises one or more straps disposed thereon, wherein a first side of the first frame member and a first side of the third frame member are selectively coupled to a first surface of the interior area of the flexible shell when the frame assembly is configured in the first configuration, wherein the selective coupling comprises at least one frame attachment portion disposed on the first surface of the interior area, the at least one frame attachment portion comprising a hook-and-loop closure configured to wrap around and secure a bottom portion of the frame assembly, wherein, when the frame assembly is configured in the first configuration, the at least one frame attachment portion retains the first side of the first frame member and the first side of the third frame member in the interior area of the flexible shell while the first frame member remains not directly connected to the third frame member, wherein the hook-and-loop closure is releasable to permit the frame assembly to fold flat in the second configuration, wherein release of the hook-and-loop closure permits the second frame member to rotate relative to the first frame member and the third frame member to rotate relative to the second frame member into the second configuration in which the first frame member, the second frame member, and the third frame member are stacked on one another such that the frame assembly is configured to be laid flat.

2. The apparatus of claim 1 wherein the flexible shell is configured to be disposed on the first frame member, the second frame member, and the third frame member when the frame assembly is configured in the first configuration.

3. The apparatus of claim 1 wherein the second side of the second frame member and a second side of the third frame member are selectively coupled to a second surface of the interior area of the flexible shell when the frame assembly is configured in the first configuration.

4. The apparatus of claim 1 wherein the first side of the first frame member and the first side of the third frame member are selectively removed from the first surface of the interior area of the flexible shell when the frame assembly is configured in the second configuration.

5. The apparatus of claim 1 wherein the flexible shell is collapsible when the frame assembly is configured in the second configuration.

6. The apparatus of claim 1 further comprising a fabric mat coupled to a surface of the flexible shell.

7. The apparatus of claim 6 wherein the flexible shell comprises at least one pocket disposed on an exterior surface of the flexible shell adjacent to the front panel, and wherein a first side of the fabric mat is coupled to a surface of the at least one pocket via a zipper.

8. The apparatus of claim 7 wherein the fabric mat is configured to be selectively stored in and removed from the at least one pocket, and wherein, when the fabric mat is coupled to the surface of the at least one pocket and a user's body weight is applied against the fabric mat on a ground surface, the secure interface between the fabric mat and the surface of the at least one pocket inhibits the apparatus from sliding on the ground surface.

9. An apparatus comprising:

a frame assembly configured to be selectively configured between a first configuration and a second configuration, wherein the frame assembly comprises a first frame member configured to define a first rectangular area, a second frame member configured to define a second rectangular area, and a third frame member configured to define a third rectangular area, wherein the second frame member is rotatably coupled to the first frame member at a first side of the second frame member, wherein the second frame member is rotatably coupled to the third frame member at a second side of the second frame member, wherein the second side is opposite the first side, wherein the first frame member is not directly connected to the third frame member, wherein the frame assembly is configured in a triangular prism shape when configured in the first configuration, and wherein the frame assembly is configured to fold flat when configured in the second configuration; and a flexible shell constructed of a fabric material, the flexible shell comprising an exterior surface and an internal area, wherein the flexible shell is configured to be disposed on all lateral edges of the frame assembly when the frame assembly is configured in the first configuration, wherein the flexible shell comprises a front panel and a zippered closure configured to selectively open and close the front panel to expose the internal area, wherein an interior surface of the flexible shell comprises one or more straps disposed thereon, wherein the frame assembly is selectively housed in the internal area of the flexible shell when the frame assembly is configured in the first configuration, and wherein the flexible shell comprises first and second frame attachment portions disposed on a surface of the internal area, each frame attachment portion comprising a hook-and-loop closure configured to wrap around and secure a bottom portion of the frame assembly, wherein, when the frame assembly is configured in the first configuration, the first frame attachment portion retains a side of the first frame member and a side of the third frame member in the internal area of the flexible shell, and the second frame attachment portion retains a side of the second frame member in the internal area of the flexible shell, and wherein the hook-and-loop closures of the first and second frame attachment portions are releasable to permit the second frame member to rotate relative to the first frame member and the third frame member to rotate relative to the second frame member into the second configuration in which the first frame member, the second frame member, and the third frame member are stacked on one another such that the frame assembly is configured to be laid flat.

10. The apparatus of claim 9 wherein the flexible shell is collapsible when the frame assembly is configured in the second configuration.

11. The apparatus of claim 9 wherein the flexible shell comprises a zippered portion configured to selectively expose and conceal the internal area of the flexible shell.

12. The apparatus of claim 9 further comprising a fabric mat coupled to a surface of the flexible shell.

13. The apparatus of claim 12 wherein the flexible shell comprises at least one pocket disposed on the exterior surface of the flexible shell, and wherein a first side of the fabric mat is coupled to a surface of the at least one pocket via a zipper.

14. The apparatus of claim 13 wherein the fabric mat is configured to be selectively stored in and removed from the at least one pocket, and wherein, when the fabric mat is coupled to the surface of the at least one pocket and a user's body weight is applied against the fabric mat on a ground surface, the secure interface between the fabric mat and the surface of the at least one pocket inhibits the apparatus from sliding on the ground surface.

15. An apparatus comprising:

a frame assembly configured to be selectively configured between a first configuration and a second configuration, wherein the frame assembly comprises a first frame member configured to define a first rectangular area, a second frame member configured to define a second rectangular area, and a third frame member configured to define a third rectangular area, wherein the second frame member is rotatably coupled to the first frame member at a first side of the second frame member, wherein the second frame member is rotatably coupled to the third frame member at a second side of the second frame member, wherein the second side is opposite the first side, wherein the first frame member is not directly connected to the third frame member, wherein the frame assembly is configured in a triangular prism shape when configured in the first configuration, and wherein the frame assembly is configured to fold flat when configured in the second configuration; and a flexible shell constructed of a fabric material, the flexible shell comprising an exterior surface and an internal area, wherein the frame assembly is selectively housed in the internal area of the flexible shell, wherein the flexible shell comprises a front panel and a zippered closure configured to selectively open and close the front panel to expose the internal area, wherein an interior surface of the flexible shell comprises one or more straps disposed thereon, wherein the frame assembly is selectively coupled to at least one surface of the internal area of the flexible shell when the frame assembly is configured in the first configuration, wherein the selective coupling comprises first and second frame attachment portions disposed on the at least one surface of the internal area, each frame attachment portion comprising a hook-and-loop closure configured to wrap around and secure a bottom portion of the frame assembly, wherein, when the frame assembly is configured in the first configuration, the first frame attachment portion retains a side of the first frame member and a side of the third frame member in the internal area of the flexible shell, and the second frame attachment portion retains a side of the second frame member in the internal area of the flexible shell, wherein the frame assembly is selectively disconnected from the at least one surface of the internal area of the flexible shell when the frame assembly is configured in the second configuration by releasing the hook-and-loop closures of the first and second frame attachment portions, wherein release of the hook-and-loop closures permits the second frame member to rotate relative to the first frame member and the third frame member to rotate relative to the second frame member into the second configuration in which the first frame member, the second frame member, and the third frame member are stacked on one another such that the frame assembly is configured to be laid flat.

16. The apparatus of claim 15 wherein the flexible shell is collapsible when the frame assembly is configured in the second configuration.

17. The apparatus of claim 15 further comprising a fabric mat coupled to the flexible shell.

18. The apparatus of claim 17 wherein the flexible shell comprises at least one pocket disposed on the exterior surface of the flexible shell, and wherein a first side of the fabric mat is coupled to a surface of the at least one pocket via a zipper.

19. The apparatus of claim 18 wherein the fabric mat is configured to be selectively stored in and removed from the at least one pocket, and wherein, when the fabric mat is coupled to the surface of the at least one pocket and a user's body weight is applied against the fabric mat on a ground surface, the secure interface between the fabric mat and the surface of the at least one pocket inhibits the apparatus from sliding on the ground surface.

* * * * *